United States Patent [19]

Kaye

[11] 4,284,021

[45] Aug. 18, 1981

[54] WOVEN GROUND FOR EMBROIDERY

[76] Inventor: Dianne Kaye, 22 Captain Brown's La., Acton, Mass.

[21] Appl. No.: 125,222

[22] Filed: Feb. 27, 1980

Related U.S. Application Data

[63] Continuation-in-part of Ser. No. 888,377, Mar. 20, 1978, Pat. No. 4,191,219.

[51] Int. Cl.[3] ..... D05C 17/00

[52] U.S. Cl. ..... 112/439

[58] Field of Search ..... 139/383 R, DIG. 1; 112/402, 439

[56] References Cited

U.S. PATENT DOCUMENTS

| | | | |
|---|---|---|---|
| 1,475,250 | 11/1923 | Sundh | 139/DIG. 1 |
| 1,869,386 | 8/1932 | Marzak | 139/439 |
| 4,098,210 | 7/1978 | Wright | 112/439 |

*Primary Examiner*—Henry Jaudon
*Attorney, Agent, or Firm*—Milton Oliver

[57] ABSTRACT

In the preferred embodiment, the triaxial fabric is adapted for use as a needlepoint canvas with the yarns forming the fabric being defined in three sets of the yarn courses with the courses within each set being parallel. The courses of each set are angular to the courses of the other two sets, usually at a 60° angle with the courses from all three sets commonly intersecting at a plurality of points in a repetitive pattern over the fabric. Preferably, one of the sets is at all intersecting points sandwiched between the yarn courses of the other two sets.

The equilateral configuration of the pores of the canvas facilitates embroidery of patterns having 30°, 60° or 120° corners and permits contiguous placement of embroidery patches which are composed of stitches oriented along non-parallel, non-orthogonal axes.

4 Claims, 6 Drawing Figures

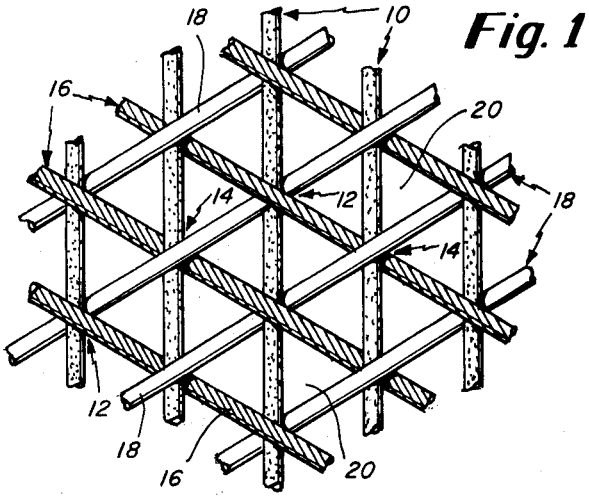
Fig. 1
Fig. 2
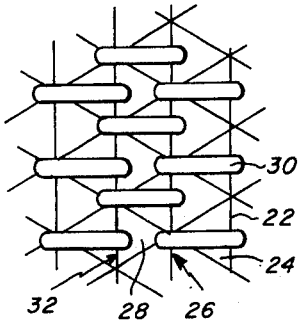
Fig. 3
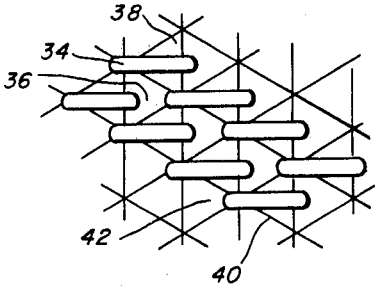
Fig. 4
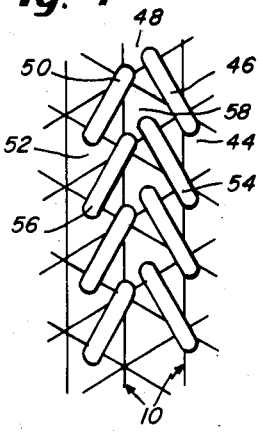
Fig. 5
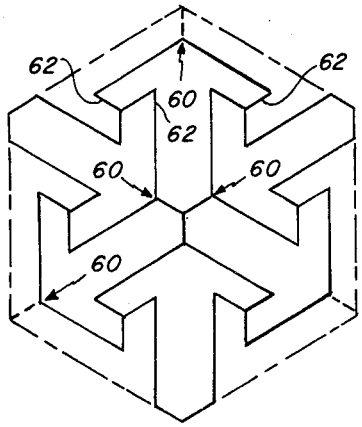
Fig. 6
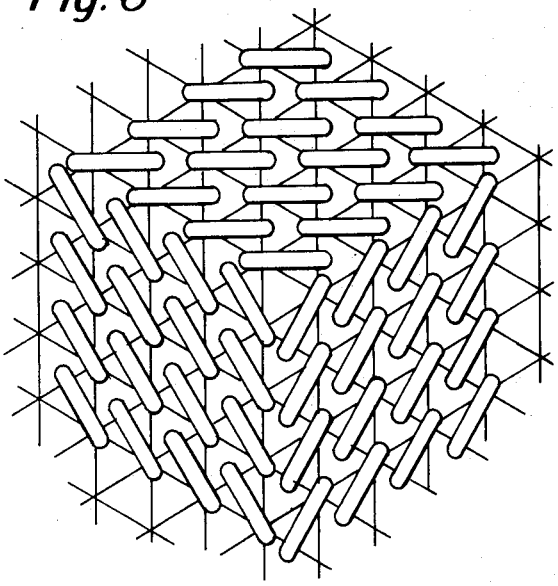

WOVEN GROUND FOR EMBROIDERY

RELATED APPLICATION

This application is a continuation-in-part of application Ser. No. 888,377, filed Mar. 20, 1978 and entitled "Triaxial Fabric Pattern".

BACKGROUND OF THE INVENTION

Embroidery and needlepoint fabric has commonly been woven in a simple orthogonal or rectangular pattern. It has been found that such a pattern severely restricts the type of designs that can be made with the rectangular pattern substrate. There are prior art patents that do disclose certain types of triaxial patterns. For example, the Preisig U.S. Pat. No. 264,194 suggests a triangular fringe or border for other fabrics, but does not disclose how its intersections are woven. The Stuart U.S. Pat. No. 1,368,215 discloses a fabric having triangular and trapezoidal pores, but having no three-layer intersections as is important with regard to the present invention. Also, there are a number of triaxial textile and machine patents which have issued to N. F. Doweave, Inc., such as U.S. Pat. No. Re. 28,155; U.S. Pat. Nos. 3,799,209, 3,874,433; 3,965,939; 4,015,637; 4,066,104.

The Dow patents disclose fabrics in which the yarns are interlocked at intersections to prevent slippage and maximize tear resistance. See for example FIG. 1 of reissue U.S. Pat. No. 28,155. In that patent no intersection is composed of more than two layers. On the other hand, in accordance with the present invention, the fabric has no such space-consuming interlock arrangement but instead provides the preferred three-layer intersection so as to maximize the porosity of the fabric. This porosity is important from the standpoint of needlepoint work on the fabric especially when using quite fluffy yarns for needlepointing.

SUMMARY OF THE INVENTION

In accordance with the present invention in the preferred form, the fabric has a warp whose threads form the middle layer of each intersection of fabric threads and two wefts, each disposed at an acute angle clockwise or counterclockwise from the warp and which may conveniently be designated as the two o'clock and ten o'clock wefts, respectively. Each weft thread passes alternately over and under the threads running in the other two directions. Thus, if all the threads of one weft pass over one warp thread, they will pass under the adjacent parallel warp threads to the left and right of the first warp thread. If a two o'clock weft thread passes over a particular ten o'clock weft thread, the adjacent parallel two o'clock weft thread passes under the same ten o'clock weft thread, and vice versa.

The fabric may be protected against fraying by folding over at an approximately 60° angle the threads of one weft set at the edge of the fabric to become threads of the other weft set.

The tendency of the threads to slip laterally past one another at the unstabilized intersections of this fabric may be counteracted by starching or glazing the fabric so that each thread remains straight between edges of the fabric. However, for some applications it may be desirable to have this unstabilized intersection as there is then some "give" to the fabric which may be advantageous in some applications depending upon the type of pattern that is being needlepointed.

BRIEF DESCRIPTION OF THE DRAWINGS

Numerous other objects and advantages of the present invention will be better understood upon a reading of the following description taken in conjunction with the accompanying drawings, in which:

FIG. 1 is a fragmentary enlarged plan view of the preferred embodiment of the fabric of this invention, showing the warp yarn courses running vertically and the two sets of weft yarn courses running crosswise;

FIG. 2 is a schematic diagram of the needlepoint canvas of this invention with a strand of needlepoint yarn embroidered thereon in a Pyramid stitch, Basketweave style;

FIG. 3 is a schematic of the canvas embroided in a Pyramid stitch, Continental style;

FIG. 4 is a schematic of the canvas embroidered in a Knitting stitch;

FIG. 5 is an example of one of the embroidery patterns practical only with this new canvas; and FIG. 6 is an example of patterns of stitches oriented along three different non-orthogon axes.

In FIGS. 2, 3, 4, 5 and 6 embroidery stitches are represented by ovals in front of the substrate.

DETAILED DESCRIPTION OF THE DRAWINGS

In FIG. 1 there is shown a relatively porous embodiment of the fabric of this invention in an enlarged view. The warp comprises a plurality of parallel yarn courses 10 which at intersections 12 and 14 are disposed between the courses 16 and 18 of the 10 o'clock and 2 o'clock wefts, respectively. At intersections 12, the courses of weft 16 are uppermost and the courses of weft 18 are the lowest layer, while at intersections 14, the positions of the wefts are reversed. At both kinds of intersections 12 and 14, the axis of a course 10 intersects the axis of a course 16 and the axis of a course 18. The stacking of courses at intersections, as opposed to the abutting and interlocking of courses featured in prior art triaxial fabrics, allows the creation of large triangular pores 20. When the triaxial fabric is intended as a substrate for embroidery, the embroidery yarns are threaded through the pores 20. The fact that the dimensions of a pore may be made several times that of the bordering yarn courses permits embroidering yarns to fluff out after passing through the pore, facilitating complete coverage of the substrate by the embroidery.

The particular weave arrangement shown in FIG. 1 may be made in a number of different ways. For example, some of the weave machines such as shown in U.S. Pat. No. 4,066,104 may be modified so as to accomplish a weave as taught in accordance with the present invention and shown in FIG. 1. Also, older manual techniques may be employed.

In FIG. 1 the area of the pores 20 is each triangular-shaped and preferably covers an area comparable to the area of the adjacent yarn courses defining the pore. The pore is also sufficiently sized to receive one or more yarn courses used in needlepointing. The diameter of a yarn course that passes through the pore is at least on the order of the diameter of one of the courses 10, 16 or 18.

As is well known, the process of needlepoint embroidery involves threading a length of embroidery yarn through a needle, pulling the needle and trailing yarn up through a pore in the canvas, bringing them a short distance across the front of the fabric, inserting them back through another pore in the fabric and repeating these extraction and insertion steps using the same length of embroidery yarn at successive nearby pairs of pores.

The canvas of the present invention may be represented schematically as a continuous pattern of isoceles triangles, in which the edges of each triangle represent the warp and wefts and the space in between represents the pore 20. For purposes of the following description, the "base" of a triangle refers to a warp or weft line segment across which embroidery yarn is bent upon passage through the pore defined by the triangle to form an embroidery loop perpendicular to the base segment while the "apex" refers to the point of a pore at which the embroidery yarn is disposed at approximately a 30° angle to each of the defining canvas line segments. A "contiguous" triangle is one which shares a defining canvas line segment with the triangle first mentioned, while an "opposing" triangle is one whose apex is formed by the same canvas intersection as the noncontiguous triangle whose base is parallel to its own. Base-contiguous triangles are those which share a defining base line segment but face in opposite directions, e.g. left and right if the base is vertical.

In FIGS. 2 and 3, the base segments as shown are all warp yarns of the canvas, but it will be appreciated that a simple 60° rotation either clockwise or counterclockwise of the FIG. would illustrate the same stitch with one or the other of the wefts chosen for base segment use and, in fact, particular designs may combine embroidery stitches oriented along two or three non-parallel axes. While an infinite number of stitch techniques are possible, many of which are impossible on conventional embroidery grounds, for simplicity's sake we have chosen to diagram as examples one basic stitch, in two variations, and one slightly more advanced, decorative stitch.

The first stitch is the Pyramid stitch. This will be shown in two variations. Both of them appear the same when viewed from the front of the canvas, but they are worked differently for two different applications. The first method is the Basketweave Pyramid, shown in FIG. 2. This is used when covering a background area. The second method is the Continental Pyramid, shown in FIG. 3. This is used when the formation of a single line of Pyramid stitches is desired.

The second stitch, shown in FIG. 4, which will be referred to as the Knitting stitch, involves successive repetitions of groups of three stitches, each on a different axis. Only two of the three stitches of each triplet remain permanently exposed, so only they are illustrated.

In the Basketweave style, starting at the lower right corner of FIG. 2, embroidery yarn is brought up through the canvas and folded over the rightmost vertical base line segment 22 (a warp thread in this example). The yarn is brought across the left-facing base-contiguous triangle 24 and the nearest parallel warp thread 26 and inserted in the right-facing triangle 28 opposing the base-contiguous one. It is then looped back underneath the two warp threads, brought up and folded over the adjacent higher base line segment to form a second stitch 30 parallel to the first, describing altogether a Z-shaped path.

It will be appreciated that the repitition of these steps could create as long a column of parallel stitches as desired, but for simplicity only three stitches are shown. When the desired end of a column is reached, the yarn is looped back underneath only one warp thread 26 to start the middle column of stitches shown in FIG. 2, which interdigitates with the first column as it descends in a "reverse Z" path. At the bottom end of the middle column, the yarn is looped under only the next-to-leftmost warp 32 to start the ascending left column. Each stitch on the front of the canvas crosses two parallel threads to which it is orthogonal.

In the Continental style shown in FIG. 3, each stitch's base line segment is parallel to the last's, rather than colinear, as in the previous example. Starting with the topmost stitch 34 shown, the yarn is brought underneath three vertical (warp) threads and brought up again between the same two 10 o'clock wefts which defined the base line segment of the first stitch. Its insertion pore 36 is contiguous to but below the base-contiguous triangle 38 of the first stitch. By repetition of this process, a downwardly and rightwardly stepped series of parallel but offset stitches are formed. If a thicker embroidery line is desired, direction can be reversed by bringing the yarn on the back side of the canvas parallel to the 2 o'clock weft and under the next lower 10 o'clock weft 40, then up at the apex of a right-facing triangle 42 and down over the two warp threads to the right. Each stitch is made left-to-right instead of right-to-left as in the previous series. An upwardly and leftwardly stepped series of stitches is created by bringing the yarn back under the leftward three warp threads between stitches and up each time between the same pair of 10 o'clock wefts.

The Knitting stitch shown in FIG. 4 is another which begins at the apex rather than the base of the extraction pore 44. Starting with the lower end of the stitch 46 shown in upper right, the yarn describes an 11 o'clock path across two 2 o'clock wefts. It is then brought under the two nearest lower 10 o'clock wefts and back over them along a 1 o'clock path into the same insertion pore 48 to form the stitch 50 shown in upper left. It is then brought underneath to the starting pore 44 of the first stitch, out and across two warp threads 10 horizontally right to left and into the extraction pore 52 of the second stitch 50. This third stitch is not shown because it becomes obscured by the next triplet of stitches, which begins one 10 o'clock weft lower than the first triplet. Both non-horizontal stitches 54 and 56 of the second triplet loop over the third, horizontal stitch of the first triplet, and are inserted into the right-facing pore 58 directly below that of the first triplet's non-horizontal stitches. Repetition of these steps produces a descending column of decorative triplets.

The pattern of interlocking arrows shown at a reduced scale in FIG. 5 is exemplary of the patterns incorporating 60° and 120° angles which are difficult or impossible on regular orthogonal canvas but simple on the triaxial canvas of the present invention. The tip 60 of each arrow encompasses a 120° angle, while the end 62 of each barb is a sharp 60°. For contrast purposes, each contiguous arrow could be embroidered with stitches oriented on a different axis than those of its neighbor. The figure is shown as a fragment to indicate the possibility of indefinite repetition.

FIG. 6 illustrates a hexagonal embroidery pattern composed of three trapezoidal patches of stitches, the axis of the stitches of each path being disposed at a 60° angle to the axis of each of the other patches. It demonstrates that such patches can be made to meet evenly without a ragged interdigitated look and without leaving gaps or lines where canvas substrate would be exposed. This feature can be very important when one patch is embroidered in a color different from that of its neighbor.

Having described a limited number of embodiments, it should now be apparent that these embodiments are exemplary and that the invention covers many variations for producing a variety of different fabric patterns all falling within the spirit and scope of this invention as defined by the appended claims:

I claim:

1. In combination, a triaxial fabric substrate and embroideries stitched onto said triaxial substrate, said fabric substrate comprising first, second and third sets of yarn courses with the yarn courses within each set being woven at an acute angle to the courses of each other set and with the yarn courses of each set intersecting yarn courses of each other set at a plurality of spaced points, said second set having yarn courses outermost of said first and third sets on one side of said fabric at selected points and said third set having yarn courses outermost of said first and second sets on the other side of the fabric at said selected points, said yarn courses defining a pattern of equilaterally triangular pores having a cross dimension at least large enough to accommodate a needlepoint yarn course, wherein said embroideries comprise stitches embroidered on said substrate in at least one linear series, each stitch of said series encircling two parallel courses of the substrate and being disposed orthogonally thereto on one face of said canvas.

2. The combination of claim 1, wherein said embroideries comprise a series of stitches embroidered on said substrate each successive stitch encircling two parallel courses of said substrate, only one of which was encircled by the previous stitch.

3. The combination of claim 2, wherein said embroideries comprise a series of triplets of stitches embroidered on said substrate, each stitch of each said triplet being disposed at a 60° angle to each other stitch of said triplet.

4. The combination of claim 3, wherein said embroideries comprise patches of embroidery on said substrate, each patch having corners subtending angles which are integer multiples of 30 degrees.

* * * * *